US008082613B2

(12) United States Patent
Rozema et al.

(10) Patent No.: US 8,082,613 B2
(45) Date of Patent: Dec. 27, 2011

(54) ROLL RESTRICTING DEVICE

(76) Inventors: Jacquelyn Kay Rozema, Holland, MI (US); Paul Craig Rozema, Holland, MI (US)

( * ) Notice: Subject to any disclaimer, the term of this patent is extended or adjusted under 35 U.S.C. 154(b) by 0 days.

(21) Appl. No.: 11/787,841

(22) Filed: Apr. 18, 2007

(65) Prior Publication Data

US 2008/0256713 A1 Oct. 23, 2008

(51) Int. Cl.

| | |
|---|---|
| ***A47B 7/00*** | (2006.01) |
| *A47C 20/00* | (2006.01) |
| *A61B 19/00* | (2006.01) |
| *A61F 5/37* | (2006.01) |
| *A61F 5/00* | (2006.01) |

(52) U.S. Cl. ..... 5/621; 5/630; 128/869; 128/870; 602/19

(58) Field of Classification Search ..... 5/632, 630, 5/621, 624; 128/845, 869, 870; 602/19
See application file for complete search history.

(56) References Cited

U.S. PATENT DOCUMENTS

| | | | | |
|---|---|---|---|---|
| 4,832,053 | A * | 5/1989 | McCarthy | 128/869 |
| 5,038,799 | A * | 8/1991 | Fowler et al. | 128/878 |
| 5,072,725 | A * | 12/1991 | Miller | 602/19 |

* cited by examiner

*Primary Examiner* — Jonathan Liu
(74) *Attorney, Agent, or Firm* — King & Partners, PLC

(57) ABSTRACT

A roll restricting device including: a support member, wherein the support member is configured to surround at least a portion of an individual, and further wherein the support member includes an outer surface, and an inner surface; a roll restriction member, wherein the roll restriction member substantially precludes an infant from rolling over; and optionally one or more roll restriction member fastener(s), wherein the one or more restriction member fastener(s) releasably secures the roll restriction member to the support member.

13 Claims, 4 Drawing Sheets

ROLL RESTRICTING DEVICE

CROSS-REFERENCE TO RELATED APPLICATION(S)

Not Applicable

BACKGROUND OF THE INVENTION

1. Field of the Invention

The present invention relates in general to a roll restricting device, and more particularly, to a roll restricting device which is operatively configured for comfortable securement around an individual, such as an infant or child, in order to prevent undesirable rolling over.

2. Background Art

To the best of Applicant's knowledge, a roll restricting device as disclosed herein does not currently exist. However, the need for a roll restricting device has become more evident, particularly among families with babies or children having certain medical conditions. To be sure, a device which restricts individuals from undesirable rolling over is highly desirable for a plurality of reasons.

A number of medical conditions may necessitate the use of a roll restricting device including, among others, mitochondrial disease. According to the United Mitochondrial Disease Foundation and the Cleveland Clinic Health Information Center, approximately one in 4,000 children in the United States will develop mitochondrial disease. Mitochondria contain the genetic material present in every cell in the body and are responsible for converting food and oxygen into energy. For individuals with mitochondrial disease, the mitochondria fail, and less and less energy is generated within the cell, leading to cell injury and even cell death. If repeated, this process may cause whole systems to fail, and the quality of life of the person in whom this is happening may be severely compromised. Depending on which cells are affected, symptoms may include, among others, loss of motor control, muscle weakness, muscle pain, and poor growth. For infants and children, such symptoms of mitochondrial disease can hinder many important developmental milestones and may even cause developmental delays. For example, crawling requires great arm, back, and leg strength. It is often easier for a child to move about by simply rolling around on the ground. This form of mobility may continue to serve a child with mitochondrial disease as their primary means of mobility even into their toddler and preschool years. In such cases, crawling would be beneficial in order to further develop and strengthen the arm, back, and leg muscles, and to promote coordination thereof. The use of a roll restricting device is, therefore, highly desirable for parents of children with mitochondrial disease and other medical conditions which affect, for example, the muscles. By preventing rolling over, the child will attempt other forms of movement, such as crawling and, in time, walking.

It is also desirable to prevent babies from rolling over during sleep. According to the National Institute of Child Health and Human Development (NICHD), in 1993, the American Academy of Pediatrics (AAP) released its first policy statement on reducing the risk of Sudden Infant Death Syndrome (SIDS). The statement recommended that all healthy infants be placed on their backs to sleep (supine position) in order to reduce the risks of SIDS. Shortly thereafter, the NICHD joined with the AAP, the SIDS Alliance (now First Candle/SIDS Alliance), the Association of SIDS and Infant Mortality Programs, and the Maternal and Child Health Bureau of HRSA to launch the Back to Sleep campaign to help inform all parents and infant care givers about the importance of back sleeping. Since then, the percentage of infants placed on their backs to sleep has increased dramatically, and the rates of SIDS have declined by more than 50 percent. A roll restricting device is, therefore, highly desirable for use by infants during sleep. Parents and/or caregivers can prevent an infant from rolling from a supine position to a prone position (on their stomach) and, in turn, greatly reduce the risk of SIDS.

Moreover, while the supine position is recommended for sleep, the AAP does recommend supervised prone position time or "tummy time" while the infant is awake in order to strengthen and develop upper body muscles as well as to prevent skull deformities. A roll restricting device is, therefore, highly desirable for parents of infants in order to encourage "tummy time." By preventing the infant from rolling over from the prone position, such supervised "tummy time" can occur.

Accordingly, it is an object of the present invention to satisfy the commercial demand for a roll restricting device which is operatively configured for comfortable securement around an infant and/or child in order to prevent undesirable rolling over.

These and other objects of the present invention will become apparent in light of the present specification, claims, and drawings.

SUMMARY OF THE INVENTION

In one embodiment, the present invention is directed to a roll restricting device, comprising: (a) a support member, wherein the support member is configured to surround at least a portion of an individual, and further wherein the support member comprises an outer surface, and an inner surface; (b) a roll restriction member, wherein the roll restriction member substantially precludes an individual from rolling over; and (c) optionally at least one roll restriction member fastener, wherein the at least one roll restriction member fastener releasably secures the roll restriction member to the support member.

In a preferred embodiment of the present invention, the inner surface of the support member is at least partially covered with an anti-slip topcoat.

In another preferred embodiment of the present invention, the roll restricting device further comprising at least one support member fastener, wherein the at least one support member fastener releasably secures the support member substantially around at least a portion of an individual.

In yet another preferred embodiment of the present invention, the roll restricting device includes at least one support member fastener which is attached to the support member.

In another aspect of the present invention, the roll restricting device support member further comprises a first end and a second end, wherein the at least one support member fastener comprises at least one tab, and wherein the at least one tab comprises a first securement region, wherein at least a portion of the first securement region of the at least one tab is secured directly to the first end of the support member; and a second securement region, wherein the second securement region of the at least one tab is releasably secured to the second end of the support member to, in turn, associate the first end of the support member with the second end of the support member.

In this embodiment the roll restricting device's second securement region of the at least one tab may comprise a plurality of hooks, wherein the second end of the support member further comprises a plurality of loops, and wherein the plurality of hooks of the second securement region of the at least one tab releasably secures to the plurality of loops of the second end of the support member.

In yet another preferred embodiment of the present invention, the roll restricting device includes at least one tab consisting of a first tab and a second tab.

In another aspect of the present invention, the second end of the support member further comprises a plurality of hooks and a plurality of loops, wherein the second securement region of the first tab comprises a plurality of loops which releasably secures to the plurality of hooks of the second end of the support member, and further wherein the second securement region of the second tab comprises a plurality of hooks which releasably secures to the plurality of loops of the second end of the support member.

In another aspect of the present invention, the roll restriction member is substantially tubular.

In this embodiment the roll restriction member may further comprise a mid-portion and a primary back support, wherein the primary back support of the roll restriction member extends substantially downward from the mid-portion of the roll restriction member, and wherein the primary back support of the roll restriction member substantially aligns with a vertebrae of an individual during use of the roll restricting device.

In another aspect of the present invention, the support member may further comprise at least one cavity for receipt of the primary back support of the roll restriction member therein.

In another aspect of the present invention, the support member may further comprise at least one cavity for receipt of the primary back support of the roll restriction member therein.

In yet another preferred embodiment of the present invention, the roll restriction member may further comprise a T-connector, wherein the T-connector secures the primary back support to the mid-portion of the roll restriction member.

In another aspect of the present invention, the roll restricting device may further comprise a plurality of secondary back supports, wherein the plurality of secondary back supports is secured to the support member, and wherein the plurality of secondary back supports extends substantially parallel to a vertebrae of an individual during use of the roll restricting device.

In this embodiment a plurality of secondary back supports may comprise at least two secondary back supports positioned on opposite sides of a vertebrae of an individual during use of the roll restricting device.

In another aspect of the present invention, the at least one roll restriction member fastener may comprise two roll restriction member fasteners positioned on opposite sides of a vertebrae of an individual during use of the roll restricting device.

In this embodiment the at least one roll restriction member fastener may comprise at least one channel within the support member, wherein the at least one channel receives the roll restriction member therethrough, and wherein the at least one channel secures the roll restriction member to the support member.

In yet another aspect of the present invention, the roll restricting device may include one or more roll restriction members which include a first sub-component on a first plane and a second sub-component on a second plane.

In one embodiment, the present invention is also directed to a roll restricting device, comprising: (a) a support member, wherein the support member is configured to surround at least a portion of an individual, and further wherein the support member comprises an outer surface, and an inner surface; and (b) a roll restriction member, wherein the roll restriction member substantially precludes an individual from rolling over and wherein the roll restriction member comprises a first sub-component on a first plane, and a second sub-component on a second plane.

In one embodiment, the present invention is further directed to a roll restricting device, comprising: (a) a support member, wherein the support member is configured to surround at least a portion of an individual, and further wherein the support member comprises an outer surface, and an inner surface, wherein the inner surface of the support member is at least partially covered with an anti-slip topcoat, a first end and a second end, further wherein the support member comprises a plurality of cavities for receipt of a plurality of secondary back supports therein, wherein the plurality of cavities secure the plurality of secondary back supports to the support member, and at least one support member fastener wherein the at least one support member fastener releasably secures the support member substantially around at least a portion of an individual, wherein the support member fastener further comprises at least one tab, and wherein the at least one tab comprises: (1) a first securement region, wherein at least a portion of the first securement region of the at least one tab is secured directly to the first end of the support member, and (2) a second securement region, wherein the second securement region of the at least one tab is releasably secured to the second end of the support member to, in turn, associate the first end of the support member with the second end of the support member, further wherein the second end of the support member further comprises a plurality of hooks and a plurality of loops, and wherein the second securement region of the first tab comprises a plurality of loops which releasably secures to the plurality of hooks of the second end of the support member, and further wherein the second securement region of the second tab comprises a plurality of hooks which releasably secures to the plurality of loops of the second end of the support member, and further wherein the second securement region of the at least one tab comprises a plurality of hooks, and wherein the second end of the support member further comprises a plurality of loops, and wherein the plurality of hooks of the second securement region of the at least one tab releasably secures to the plurality of loops of the second end of the support member; (b) a roll restriction member, wherein the roll restriction member substantially precludes an individual from rolling over, further comprising a mid-portion and a primary back support, wherein the primary back support of the roll restriction member extends substantially downward from the mid-portion of the roll restriction member, and wherein the primary back support of the roll restriction member substantially aligns with a vertebrae of an individual during use of the roll restricting device; and (c) optionally at least one roll restriction member fastener, wherein the at least one roll restriction member fastener comprises two roll restriction member fasteners positioned on opposite sides of a vertebrae of an individual during use of the roll restricting device and releasably secures the roll restriction member to the support member.

BRIEF DESCRIPTION OF THE DRAWINGS

The invention will now be described with reference to the drawings wherein.

DETAILED DESCRIPTION OF THE INVENTION

Figure 1:
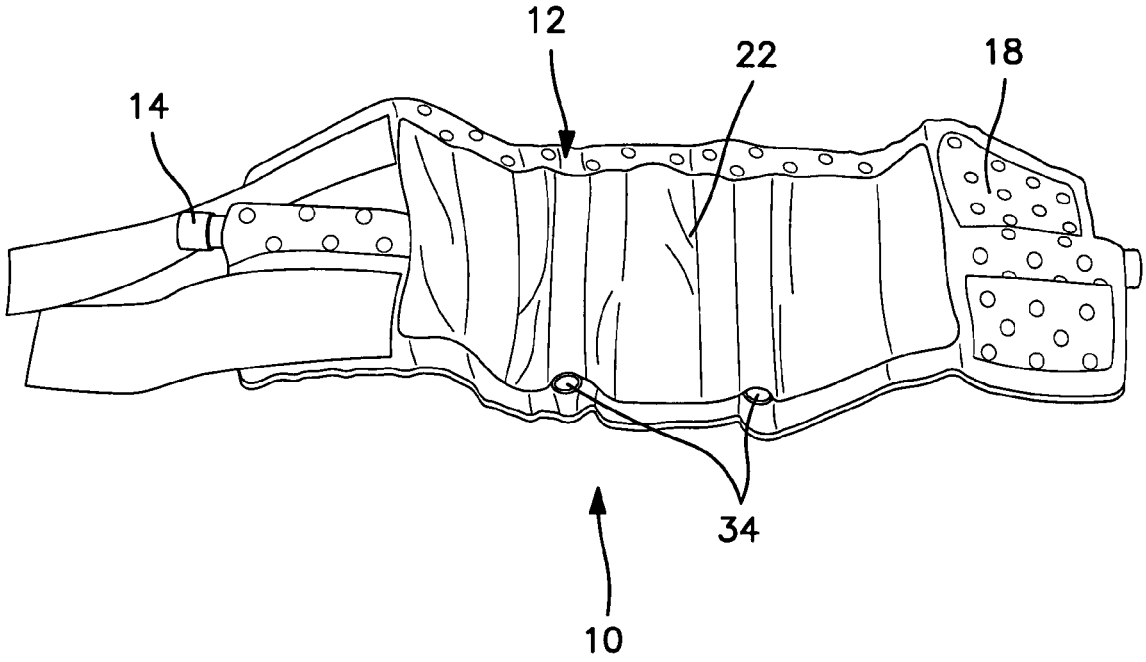
FIG. 1 is an elevated perspective representation of a roll restricting device fabricated in accordance with the present invention showing, among other things, an anti-slip coating associated with a support member.

While this invention is susceptible of embodiment in many different forms, there is shown in the drawings and will herein be described in detail several specific embodiments with the understanding that the present disclosure is to be considered as an exemplification of the principles of the invention and is not intended to limit the invention to the embodiments illustrated.

It will be understood that like or analogous elements and/or components, referred to herein, may be identified throughout the drawings with like reference characters.

Referring now to the drawings and to FIGS. 1-4 collectively, roll restricting device 10 is shown, which generally comprises support member 12, roll restriction member 14, and optionally one or more roll restriction member fasteners 16. As will be explained in greater detail below, it will be understood that, in operation, roll restricting device 10 substantially precludes an individual (e.g. infant, child, adult, etcetera) from rolling over from a supine and/or prone position to another position. It will be understood that the above-identified Figures are merely schematic representations of roll restricting device 10. As such, some of the components may have been distorted from their actual scale for pictorial clarity.

Figure 2:
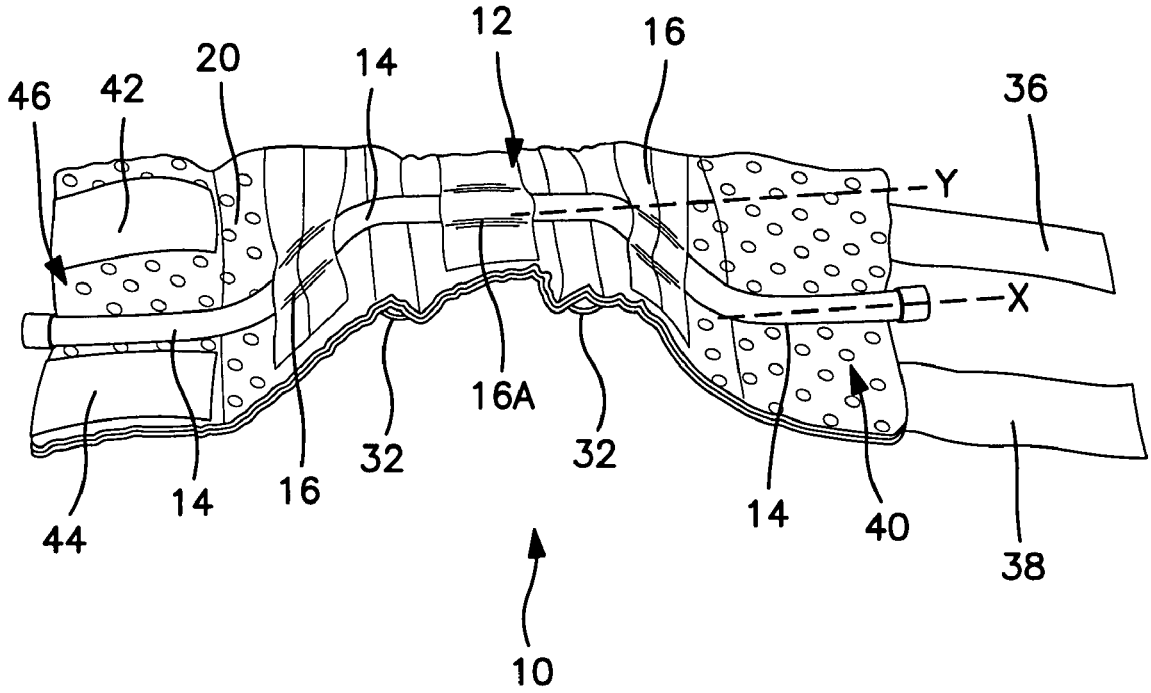
FIG. 2 is an elevated perspective representation of a roll restricting device fabricated in accordance with the present invention showing, among other things, a roll restriction member associated with a support member.

As is best shown in FIGS. 1 and 2, support member 12 is configured to surround at least a portion of an individual, and includes inner surface 18 and outer surface 20. Inner surface 18 of support member 12 preferably is capable of conforming to the outer peripheral geometry of an individual's torso—or at least a portion thereof. Preferably, support member 12 is generally rectangular in shape. However, it will be understood that while support member 12 has been disclosed as being generally rectangular, any one of a number of shapes is likewise contemplated for use in accordance with the present invention including, for example, generally triangular, square, polygonal, arbitrary, and/or curved shaped. Support member 12 may comprise a unitary member or, alternatively, may comprise a multi-piece member. It will be further understood that support member 12 may be fabricated from any one of a number of materials including elastic and/or non-elastic, natural and/or synthetic materials, such as cotton, wool, silk, polyester, rayon, spandex, metallic fibers—just to name a few.

Inner surface 18 of support member 12 is also preferably at least partially covered with anti-slip topcoat 22, which generally precludes an individual from slipping, rolling and/or rotating within support member 12 to an undesirable position. Anti-slip topcoat 22 is preferably fabricated from a material with generally non-slip properties relative to an individual's skin and/or clothing. It will be understood that anti-slip topcoat 22 is preferably secured to inner surface 18 via conventional stitching. However, other securing components are likewise contemplated for use in accordance with the present invention including, for example, adhesives, rivets, threaded and non-threaded fasteners, staples, snaps—just to name a few.

Figure 4:
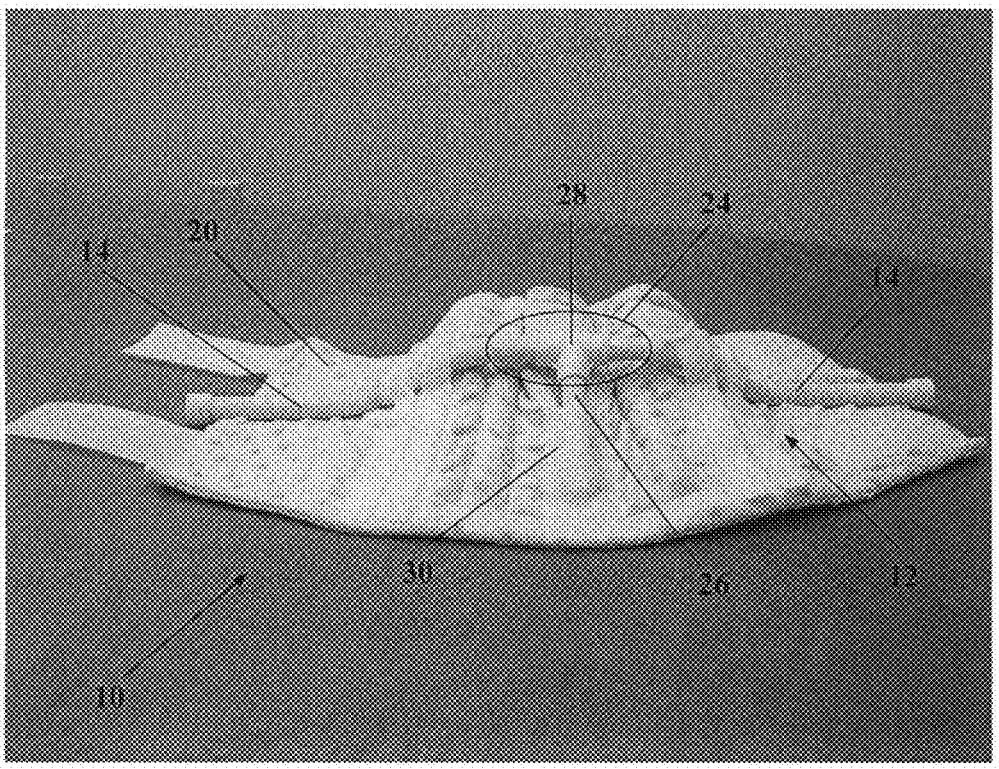
FIG. 4 is an elevated perspective representation of a roll restricting device fabricated in accordance with the present invention showing, among other things, a T-connector inserted in a channel of an associated support member.

As is best shown in FIGS. 2 and 4, roll restriction member 14 is associated with support member 12 and preferably cooperatively interacts with the same to substantially preclude an individual from rolling over. Such cooperative interaction is generally maintained via one or more roll restriction member fasteners 16, 16A—although it is contemplated that support member 12 and roll restriction member 14 be unitary in nature, thereby integrating any cooperative interaction. Preferably, roll restriction member 14 is substantially tubular. However, any one of a number of configurations that would be known to those having ordinary skill in the art having the present disclosure before them are likewise contemplated for use. It will be understood that roll restriction member 14 may be fabricated from any one of a number materials including natural and/or synthetic resins, metals, wood, etcetera.

As is best shown in FIG. 2, roll restriction member 14 may comprise a first sub-component (e.g. lower portion) on a first plane (e.g. plane X of FIG. 2), and a second sub-component (e.g. upper portion) on a on a second plane (e.g. plane Y of FIG. 2). Without being bound to any one particular theory, it is believed that such planar bifurcation substantially enhances the anti-roll properties of roll restriction member 14. It will be understood that roll restriction member 14 may be contoured to conform to the back of a user.

Referring now to FIG. 4, roll restriction member 14 of roll restricting device 10 may comprise mid-portion 24 and/or primary back support member 26. Preferably, primary back support member 26 of roll restriction member 14 extends substantially downward from mid-portion 24. In addition to other benefits, such as precluding deformation (e.g. bunching) of support member 12, primary back support member 26 substantially aligns with a vertebrae of an individual during normal use of the roll restricting device. In one embodiment of the present invention roll restriction member 14 may comprise T-connector 28, which may secure primary back support member 26 to mid-portion 24 of the roll restriction member 14.

As is also shown in FIG. 4, support member 12 may comprise retaining cavity 30 (e.g. pocket). Cavity 30 preferably releasably contains primary back support member 26 of roll restriction member 14. However, it will be understood that primary back support member 26 may be associated with support member 12 in any one of a number of manners known to those having ordinary skill in the art having the present disclosure before them.

Figure 3:
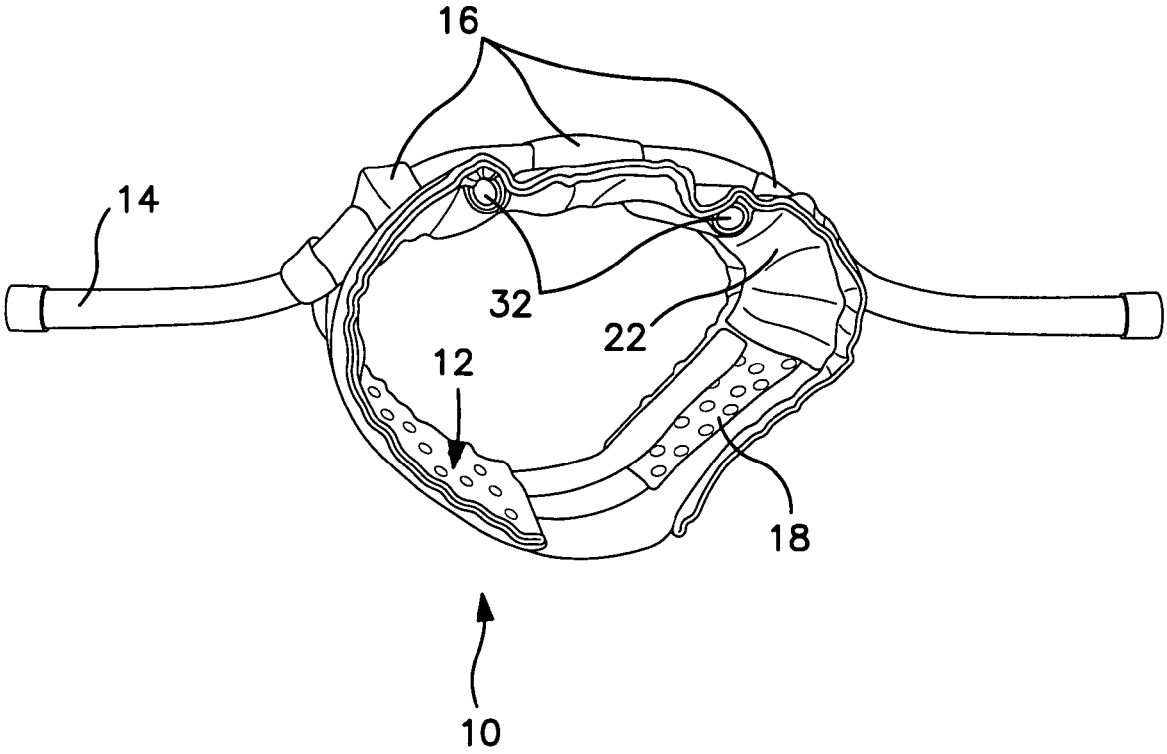
FIG. 3 is a side perspective representation of a roll restricting device fabricated in accordance with the present invention showing, among other things, cavities containing back supports associated with a support member.

As is best shown in FIGS. 1, 2, and 3 collectively, support member 12 may also comprise one or more secondary cavities 32. Secondary cavities 32 preferably releasably contain one or more secondary back support members 34 of support member 12. Secondary back support members 34 are preferably positioned on opposite sides of a vertebrae of a user and preferably extend substantially parallel to a vertebrae of an individual during normal use of roll restricting device 10 to, among other things, keep support member 12 from undesirable bunching and positioning during use.

Referring once again to FIGS. 2 and 3, roll restricting device 10 may include one or more roll restriction member fasteners 16. Preferably, roll restriction member fasteners 16 releasably secure roll restriction member 14 to support member 12. In one embodiment, roll restriction member fasteners 16 include a middle roll restriction member fastener comprising channel 16A associated with support member 12. Channel 16A receives roll restriction member 14 therethrough, and secures the same to the support member 12. In accordance with the present invention, two of the roll restriction member fasteners 16 may be positioned on opposite sides of the vertebrae of an individual during normal use of roll restricting device 10, and are used for enhancing the stability of roll restriction member 14. In further accordance with the present invention, roll restriction member fasteners 16 are fabricated from conventional fabric which utilize loop and hook fasteners. However, it will be understood that any one of a number of other fastening mechanisms are likewise contemplated for use.

As is shown in the Figures, roll restricting device 10 preferably comprises two separate support member fastener tab's first securement regions 36 and 38, which are associated with first end 40 of support member 12, and support member fastener tab's second securement regions 42 and 44 which are associated with second end 46 of support member 12 to facilitate the releasable securement of the roll restricting device 10 around an individual—via conventional hook and loop fasteners. It will be understood that regions 36, 38, 42, and 44 can be configured in any one of a number of ways utilizing hook and loop fastening technology.

It will be understood that when support member fastener tab's second securement regions 36 and 38 are releasably joined with support member second ends 42 and 44, respectively, they form a releasably secured support member fastener as is best shown in FIG. 3. While roll restriction member fasteners 16 have been disclosed as including conventional hook and loop fastening mechanisms, any one of a number of other fastening mechanisms are likewise contemplated for use, including adhesives, snaps, rivets, ties, threaded and/or non-threaded fasteners—just to name a few.

In operation, support member 12 of roll restricting device 10 is secured around an individual's body, whereby roll restriction member 14 is preferably positioned proximate the back of the individual. Once secured, the individual can be placed in a supine and/or prone position. Roll restricting device 10 substantially precludes the individual from rolling over, thereby maintaining a desired supine and/or prone position.

The foregoing description merely explains and illustrates the invention and the invention is not limited thereto except insofar as the appended claims are so limited, as those skilled in the art who have the disclosure before them will be able to make modifications without departing the scope of the invention.

What is claimed is:

1. A roll restricting device, comprising:

a torso support member, wherein the torso support member is configured to surround at least a portion of an individual, and further wherein the torso support member comprises a length, a width, a primary cavity, a secondary cavity, an outer surface, and an inner surface;

a roll restriction member, wherein the roll restriction member is substantially parallel to the length of the torso support member, wherein the roll restriction member comprises a first sub-component positioned on a first plane (X) and a second sub-component positioned on a second plane (Y), wherein the first plane (X) of the first sub-component is positioned below the second plane (Y) of the second sub-component relative to the length of the torso support member, wherein the first plane (X) of the first sub-component and the second support member fastener comprises at least one tab, and wherein the at least one tab comprises:

a first securement region, wherein at least a portion of the first securement region of the at least one tab is secured directly to the first end of the torso support member; and a second securement region, wherein the second securement region of the at least one tab is releasably secured to the second end of the torso support member to, in turn, associate the first end of the torso support member with the second end of the torso support member.

2. The roll restricting device according to claim 1, wherein the inner surface of the torso support member is at least partially covered with an anti-slip topcoat.

3. The roll restricting device according to claim 1, further comprising at least one torso support member fastener, wherein the at least one torso support member fastener releasably secures the torso support member substantially around at least a portion of an individual.

4. The roll restricting device according to claim 3, wherein the at least one torso support member fastener is attached to the torso support member.

5. The roll restricting device according to claim 1, wherein the torso support member further comprises a first end and a second end and at least one torso support member fastener, wherein the at least one torso (Y) of the second sub-component relative to the length of the torso support member, wherein the first plane (X) of the first sub-component and the second plane (Y) of the second sub-component are substantially parallel to one another, and wherein the roll restriction member substantially precludes an individual from rolling over;

a primary back support member, wherein the primary back support member extends substantially orthogonally from the second sub-component of the roll restriction member into the primary cavity of the torso support member;

a pair of secondary back support members, wherein the pair of secondary back support members are retained within the plurality of secondary cavities of the torso support member, and are positioned substantially parallel to one another and the primary back support member;

at least one roll restriction member fastener, wherein the at least one roll restriction member fastener releasably secures the roll restriction member to the torso support member; and wherein the roll restriction member further comprises a T-connector, wherein the T-connector directly secures the primary back support member to a mid-portion of the roll restriction member.

6. The roll restricting device according to claim 5, wherein the second securement region of the at least one tab comprises a plurality of hooks, and wherein the second end of the torso support member further comprises a plurality of loops, and wherein the plurality of hooks of the second securement region of the at least one tab releasably secures to the plurality of loops of the second end of the torso support member.

7. The roll restricting device according to claim 6, wherein the at least one tab consists of a first tab and a second tab.

8. The roll restricting device according to claim 7, wherein the second end of the torso support member further comprises a plurality of hooks and a plurality of loops, and wherein the second securement region of the first tab comprises a plurality of loops which releasably secures to the plurality of hooks of the second end of the torso support member, and further wherein the second securement region of the second tab comprises a plurality of hooks which releasably secures to the plurality of loops of the second end of the torso support member.

9. The roll restricting device according to claim 1, wherein the roll restriction member is substantially tubular.

10. The roll restricting device according to claim 1, wherein the roll restricting device further comprises a plurality of secondary back supports, wherein the plurality of secondary back supports are secured to the torso support member, and wherein the plurality of secondary back supports extend substantially parallel to a vertebrae of an individual during use of the roll restricting device.

11. The roll restricting device according to claim 1, wherein the at least one roll restriction member fastener consists of two roll restriction member fasteners positioned on opposite sides of a vertebrae of an individual during use of the roll restricting device.

12. The roll restricting device according to claim 1, wherein the at least one roll restriction member fastener comprises at least one channel within the torso support member, wherein the at least one channel receives the roll restriction member therethrough, and wherein the at least one channel secures the roll restriction member to the torso support member.

13. A roll restricting device, comprising:

a torso support member, wherein the torso support member is configured to surround at least a portion of an individual, and further wherein the torso support member comprises a length, a width, a primary cavity, a plurality of secondary cavities, an outer surface, and an inner surface;

a roll restriction member, wherein the roll restriction member is substantially parallel to the length of the torso support member, wherein the roll restriction member comprises a first sub-component positioned on a first plane (X) and a second sub-component positioned on a second plane (Y), wherein the first plane (X) of the first sub-component is positioned below the second plane plane (Y) of the second sub-component are substantially parallel to one another, and wherein the roll restriction member substantially precludes an individual from rolling over;

a primary back support member, wherein the primary back support member extends substantially orthogonally from the second sub-component of the roll restriction member into the primary cavity of the torso support member;

a secondary back support member, wherein the secondary back support member is retained within the secondary cavity of the torso support member, and is positioned substantially parallel to the primary back support member;

at least one roll restriction member fastener, wherein the at least one roll restriction member fastener releasably secures the roll restriction member to the torso support member; and wherein the roll restriction member further comprises a T-connector, wherein the T-connector directly secures the primary back support member to a mid-portion of the roll restriction member.

* * * * *